US010952541B2

(12) United States Patent
Pankratz

(10) Patent No.: US 10,952,541 B2
(45) Date of Patent: Mar. 23, 2021

(54) SEAT STRUCTURE FOR INFANT

(71) Applicant: NUVATE INC., Oakville (CA)

(72) Inventor: Stephen Pankratz, Oakville (CA)

(73) Assignee: NUVATE INC., Oakville (CA)

( * ) Notice: Subject to any disclaimer, the term of this patent is extended or adjusted under 35 U.S.C. 154(b) by 0 days.

(21) Appl. No.: 16/485,526

(22) PCT Filed: Mar. 22, 2018

(86) PCT No.: PCT/CA2018/050345
§ 371 (c)(1),
(2) Date: Aug. 13, 2019

(87) PCT Pub. No.: WO2018/170597
PCT Pub. Date: Sep. 27, 2018

(65) Prior Publication Data

US 2020/0046140 A1 Feb. 13, 2020

Related U.S. Application Data

(60) Provisional application No. 62/476,028, filed on Mar. 24, 2017.

(51) Int. Cl.
*A47C 1/08* (2006.01)
*A47C 1/10* (2006.01)
*A47D 1/10* (2006.01)

(52) U.S. Cl.
CPC ..... *A47D 1/10* (2013.01)

(58) Field of Classification Search
CPC .... A47D 1/0085; A47D 1/103; A47D 15/006; A47D 1/00; A47D 1/006; A47D 1/10; A47D 1/002
See application file for complete search history.

(56) References Cited

U.S. PATENT DOCUMENTS 4,441,221 A * 4/1984 Enste ..... A61G 5/1091 5/657
5,599,063 A 2/1997 Lister et al.
(Continued)

FOREIGN PATENT DOCUMENTS

CN 101233984 A 9/2012
CN 204908735 U 12/2015
(Continued)

OTHER PUBLICATIONS

International Search Report for PCT/CA2018/050345, Canadian Intellectual Property Office, dated Jul. 5, 2018.
(Continued)

*Primary Examiner* — Shin H Kim
(74) *Attorney, Agent, or Firm* — Bhole IP Law; Anil Bhole; Marc Lampert

(57) ABSTRACT

A seat structure for a baby or young infant that can facilitate an anterior pelvic tilt and hip abduction, while supporting the infant in an upright position. The infant seat structure described herein comprises a seat that is forward tilted. A pommel is provided at a forward edge of the seat that is wide enough to splay the infant's legs, provides support for the infant, and maintains their position in the seat structure. The infant seat structure also includes a back support and side supports to support the infant's/baby's upright position. The side supports do not extend substantially forward past the infant's hip joints, and therefore allow for substantial splaying of their legs. A infant's legs are able to project outwardly from the seat structure on either side of the pommel, through the two spaces that are each situated between the pommel and side supports.

12 Claims, 5 Drawing Sheets

(56) References Cited

U.S. PATENT DOCUMENTS

| | | | | |
|---|---|---|---|---|
| 6,123,390 | A * | 9/2000 | Greenwald | A47C 7/029 297/452.32 |
| 6,626,487 | B1 * | 9/2003 | Buitendach | A47D 1/00 297/153 |
| 6,877,176 | B2 * | 4/2005 | Houghteling | A47D 13/08 5/633 |
| D553,865 | S * | 10/2007 | Buitendach | D6/333 |
| D592,865 | S * | 5/2009 | Yeung | D6/333 |
| D617,103 | S * | 6/2010 | Bearup | D6/339 |
| D623,426 | S * | 9/2010 | Ramer | D6/333 |
| D660,606 | S * | 5/2012 | Dai | D6/333 |
| D660,607 | S * | 5/2012 | Dai | D6/333 |
| D667,229 | S * | 9/2012 | Sturmey | D6/339 |
| 8,651,572 | B2 * | 2/2014 | Medeiros | A47D 1/002 297/256.13 |
| 8,764,109 | B2 * | 7/2014 | Kummerfeld | A47D 1/103 297/250.1 |
| 9,603,464 | B2 * | 3/2017 | Sclare | A47D 1/10 |
| D790,236 | S * | 6/2017 | Desnos | D6/333 |
| 10,383,458 | B1 * | 8/2019 | Pagano | A47D 1/0085 |
| 10,653,250 | B1 * | 5/2020 | Flannery | A47C 7/002 |
| 2002/0135219 | A1 * | 9/2002 | Rogers | A47D 15/006 297/467 |
| 2008/0054696 | A1 * | 3/2008 | McConnell | A47D 1/0085 297/256.15 |
| 2013/0057031 | A1 * | 3/2013 | Kummerfeld | A47D 1/0085 297/174 R |
| 2017/0119172 | A1 * | 5/2017 | Sclare | A47D 1/0083 |
| 2018/0279799 | A1 * | 10/2018 | Ingraham | B60N 2/2812 |
| 2020/0046140 | A1 * | 2/2020 | Pankratz | A47D 1/10 |

FOREIGN PATENT DOCUMENTS

| | | | |
|---|---|---|---|
| CN | 205041074 | U | 2/2019 |
| EP | 1388311 | A1 | 2/2004 |
| WO | 200065965 | A1 | 11/2000 |

OTHER PUBLICATIONS

Written Opinion for PCT/CA2018/050345, Canadian Intellectual Property Office, dated Jul. 5, 2018.

Extended European Search Report for 18772214.5, European Patent Office, dated Sep. 29, 2020.

* cited by examiner

SEAT STRUCTURE FOR INFANT

REFERENCE TO RELATED APPLICATIONS

This application claims priority from U.S. provisional application 62/476,028, the contents of which are incorporated herein by reference.

FIELD OF THE INVENTION

The present invention relates to a seat structure suitable for use by an infant.

BACKGROUND OF THE INVENTION

PCT/ZA1999/00030 describes a supporting chair that enables a young or small baby who can cannot sit up safely by him or herself without assistance, to be stably propped in a sitting position. This has several advantages. It can provide a convenient means for a parent/caregiver to feed the baby using both of his or her hands. It can also satisfy the infant's desire to explore his or her environment from a sitting (instead of laying down) position.

The device described in PCT/ZA1999/00030 is a baby supporting chair which comprises a seat, a backrest, two side supports, and a front support. Between the front support and the side supports there are two grooves for the baby's legs to project outwardly forward from the seat. The seat of the chair is at a level equal to or lower than the level of the bottoms of the two grooves. This results in the seated infant's pelvis being positioned in a posteriorly tilted orientation. Many experts believe however that while the baby/young infant is sitting, it's preferable for their pelvis to be positioned in an anterior pelvic tilt which promotes proper spinal alignment, engages their core muscles and encourages better posture. A variety of sitting wedges are available that accomplish this. However, these wedges do not provide sufficient support to keep a young infant in an upright position.

In addition, the side supports of the invention described in PCT/ZA1999/00030 and many floor seats commercially available cause hip adduction (especially in larger/older infants), which can lead to hip dysplasia. Many experts feel that positions that instead encourage hip abduction in young infants is much preferred.

It is the object of the present invention to obviate or mitigate the above disadvantages.

SUMMARY OF THE INVENTION

This invention relates to a seat structure for a baby or young infant that can facilitate an anterior pelvic tilt and hip abduction, while supporting the infant in an upright position. The infant seat structure described herein comprises a seat that is forward tilted. A pommel is provided at a forward edge of the seat that is wide enough to splay the infant's legs, provides support for the infant, and maintains their position in the seat structure. The infant seat structure also includes a back support and side supports to support the infant's/baby's upright position. The side supports do not extend forward past the infant's hip joints, and therefore allow for substantial splaying of their legs. An infant's legs are able to project outwardly from the seat structure on either side of the pommel, through the two spaces that are each situated between the pommel and side supports. When the seat is on the floor, the outer surfaces of the sitting infant's feet/ankles/heels are able to rest in front of the seat on the floor. This encourages bending of the knees and splaying of the infant's legs with external hip rotation and abduction.

In one embodiment of the invention the seat structure includes fastening mechanism, which secures the infant in place and/or prevents them from falling out. This is particularly important because the infant will be sitting upright with their core muscles engaged, and with a heightened center of gravity.

In one embodiment the seat structure includes a base that is substantially wider circumferentially than the rest of the seat structure. This discourages the seat structure from tilting over with the infant within it. This is also particularly important because the infant will be sitting upright with their core muscles engaged, and with a heightened center of gravity.

BRIEF DESCRIPTION OF THE DRAWINGS

Embodiments of the invention will now be described with reference to the accompanying drawings in which.

DETAILED DESCRIPTION OF DRAWINGS AND PREFERRED EMBODIMENTS

Figure 1:
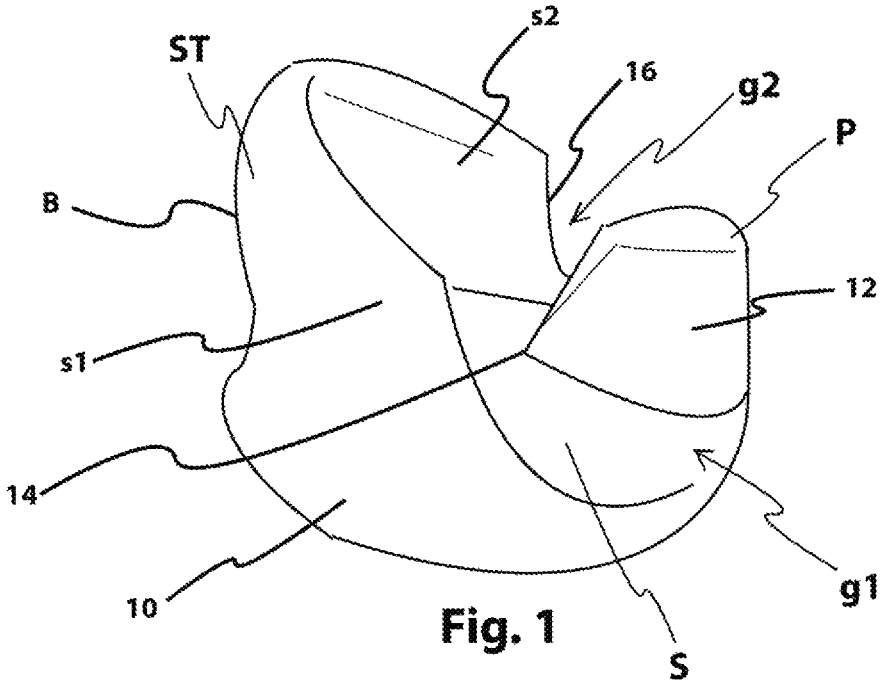
FIG. 1 is a side perspective view of one embodiment of seat structure.
Figure 2:
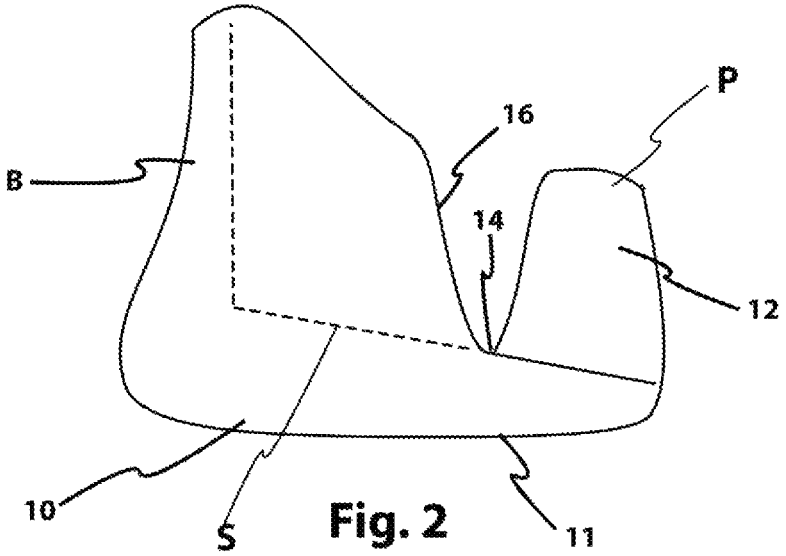
FIG. 2 is a side view of FIG. 1.
Figure 3:
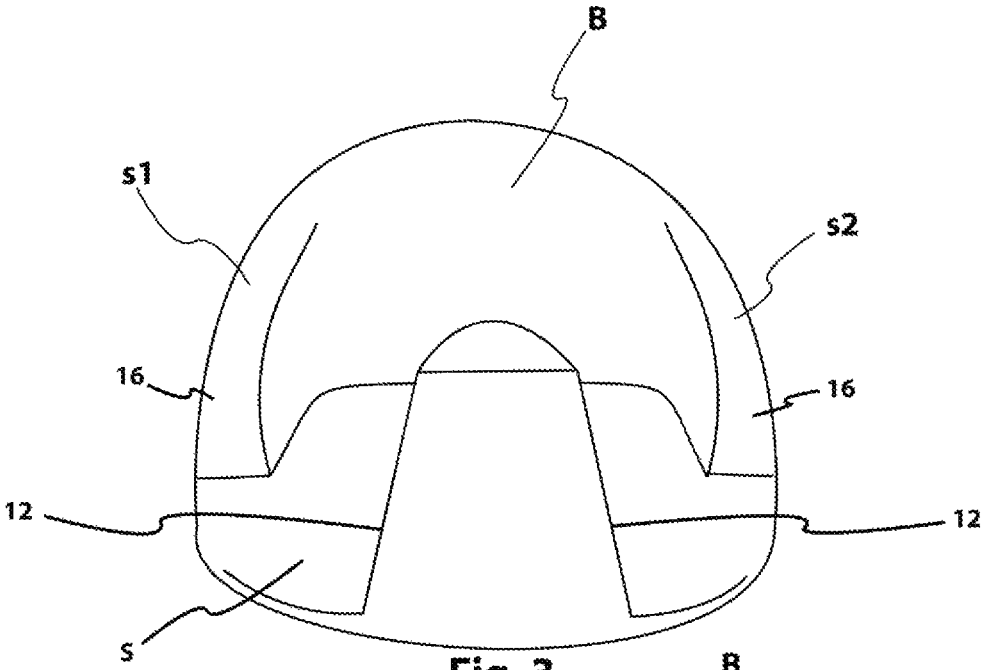
FIG. 3 is a front perspective view of FIG. 1.
Figure 4:
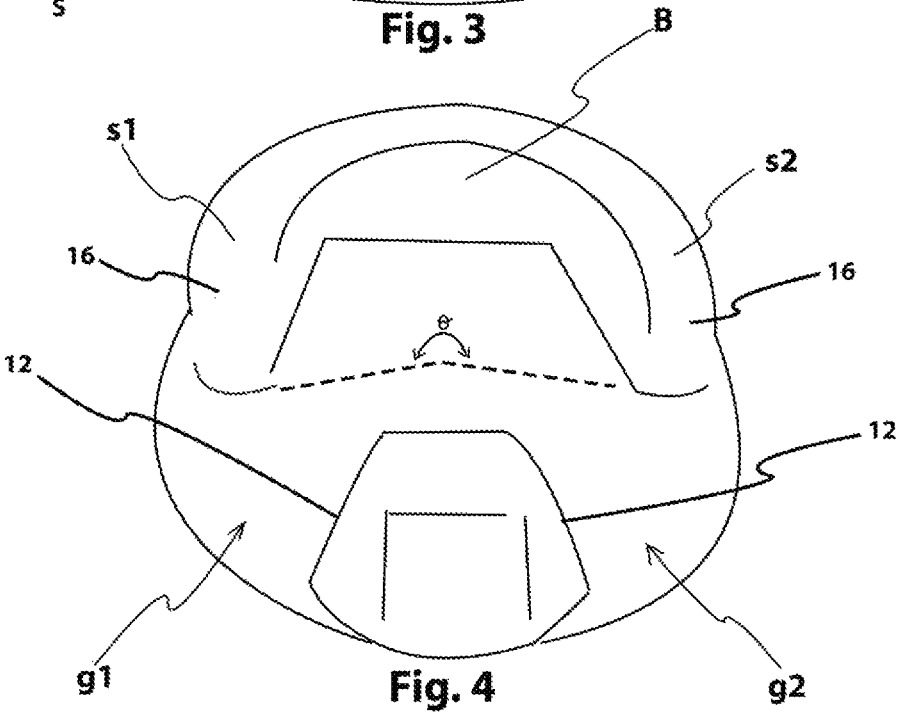
FIG. 4 is a top view of the embodiment of FIG. 1.

Referring to FIG. 1 an infant seat structure generally indicated, ST has a base 10 with a lower surface 11 for placement on a generally horizontal support structure such as a chair or the floor. The base 10 is formed with an upwardly directed generally planar seat S, and a pommel P located at a forward edge of the seat S. The seat S is forward tilted, also indicated by the dotted line S in FIG. 2, so that in use the back of the seat S is higher than the front. An angle to the lower surface 11 of the base 10 of between 2 and 20 degrees has been found satisfactory, and between 6 and 11 is preferable. It will be appreciated that this is the average angle as the seat S may be slightly concave and curved at its outer limits to blend smoothly with the surrounding structure.

The pommel P has oppositely directed flanks 12 that diverge radially outwardly at an included angle of between 1 and 90 degrees, preferably around 30 degrees, and converge upwardly at an included angle of 1-20 degrees. The radially inner extent of the pommel, indicated at 14, does not extend inwardly beyond the leading edge of the seat S by more than a distance equivalent to half the front-to-back length of the base, 10. In a typical seat structure for infant use this would be in the order of 5 inches, but may be greater with seat structures intended for special needs or rehabilitation.

The infant seat structure ST also includes a back support B and side supports s1 and s2, shown in FIG. 3-6, to support the infant's upright position. The side supports s1 and s2 diverge from the back support B and do not extend forward past the region that would normally be occupied by the infant's hip joints. Preferably, the side supports s1 and s2 diverge at a relatively wide angle of between 30 and 60 degrees to the centreline of the seat (i.e. at an included angle of between 60 and 120 degrees), and terminate at inclined leading edges 16 that do not extend forward substantially past the centre of the hip joint of an infant intended to use the seat structure. The combination of the divergent sidewalls and their relatively short length provides freedom of movement of the hip joints and therefore allows for substantial splaying of the legs. In one configuration, the radii from the center of the seat S to the leading edges 16 of the side support, as indicated by chain dot lines, subtend an included angle of between 90 and 200 degrees, preferably 160 to 190 degrees.

An infant's legs are able to project outwardly from the seat structure ST on either side of the pommel P, through spaces g1 and g2 which are situated between the flanks 12 of pommel P and the leading edges 16 of side supports s1 and s2, respectively. It will be noted that the surface of the seat S continues through the spaces g1 and g2 to the periphery of the base 10.

It is preferred that the seat is integrally molded from a durable plastic material and that the interior flanks of side supports, s1 and s2 blend smoothly with the concave seat surface S and the interior surface of the back support B. It is also preferred that the inner and side flanks of the pommel, P blend smoothly with the concave seat surface S.

In use, the infant is placed on the seat S with legs projecting through the spaces g1, g2. The forward inclination of the seat S encourages the infant's pelvis to be tilted anteriorly when seated. This position encourages the infant's core muscles to be engaged, and for the infant to be sitting in more of an upright position. The pommel P is positioned at the forward edge of the seat S and is sized to promote splaying of the infant's legs, provide support for the infant, and maintain their position in the seat structure ST. The pommel P is also effective to prevent the infant from slipping forward in the seat S. When the seat ST is on the floor, the outer surfaces of the sitting infant's feet/ankles/heels are able to rest on the floor. This encourages bending of the knees and splaying of the infant's legs with external hip rotation and abduction. The configuration of the side supports s1, s2, as described above facilitates the splaying of the legs that is promoted by the pommel P.

Figure 5:
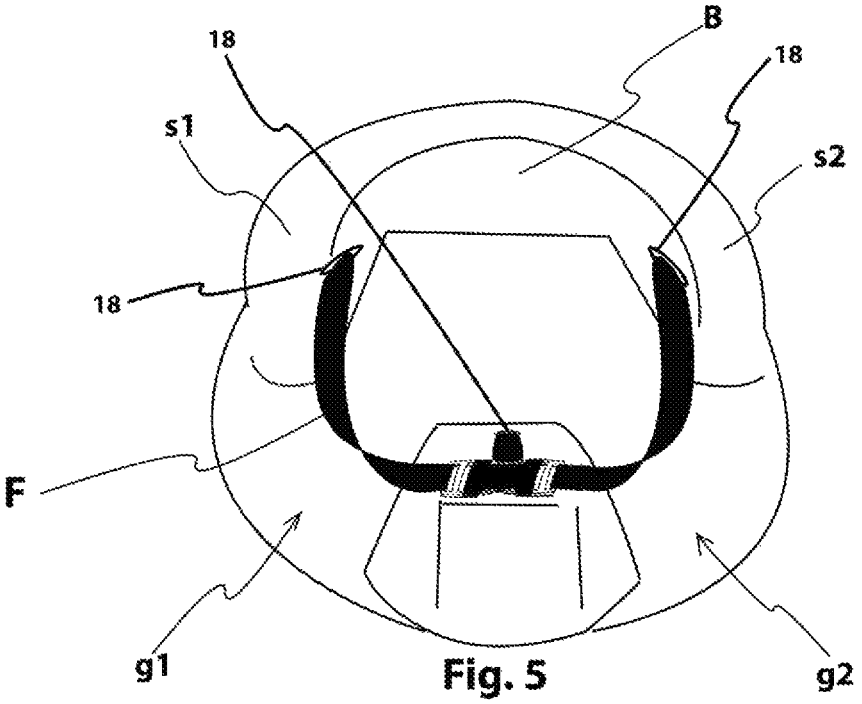
FIG. 5 is a top view of an alternative embodiment of the seat structure.
Figure 6:
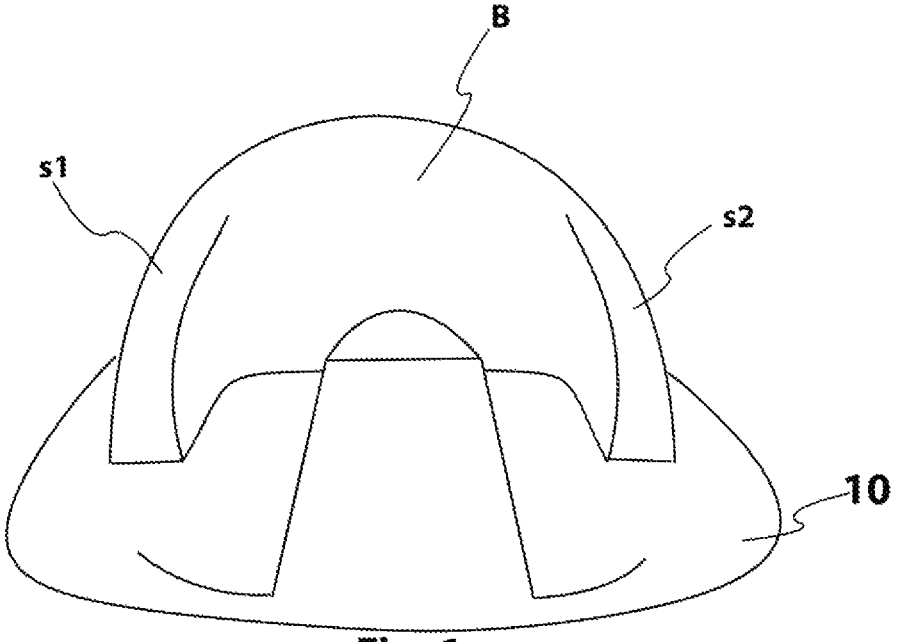
FIG. 6 is a front perspective of an alternative embodiment of the seat structure.
Figure 7:
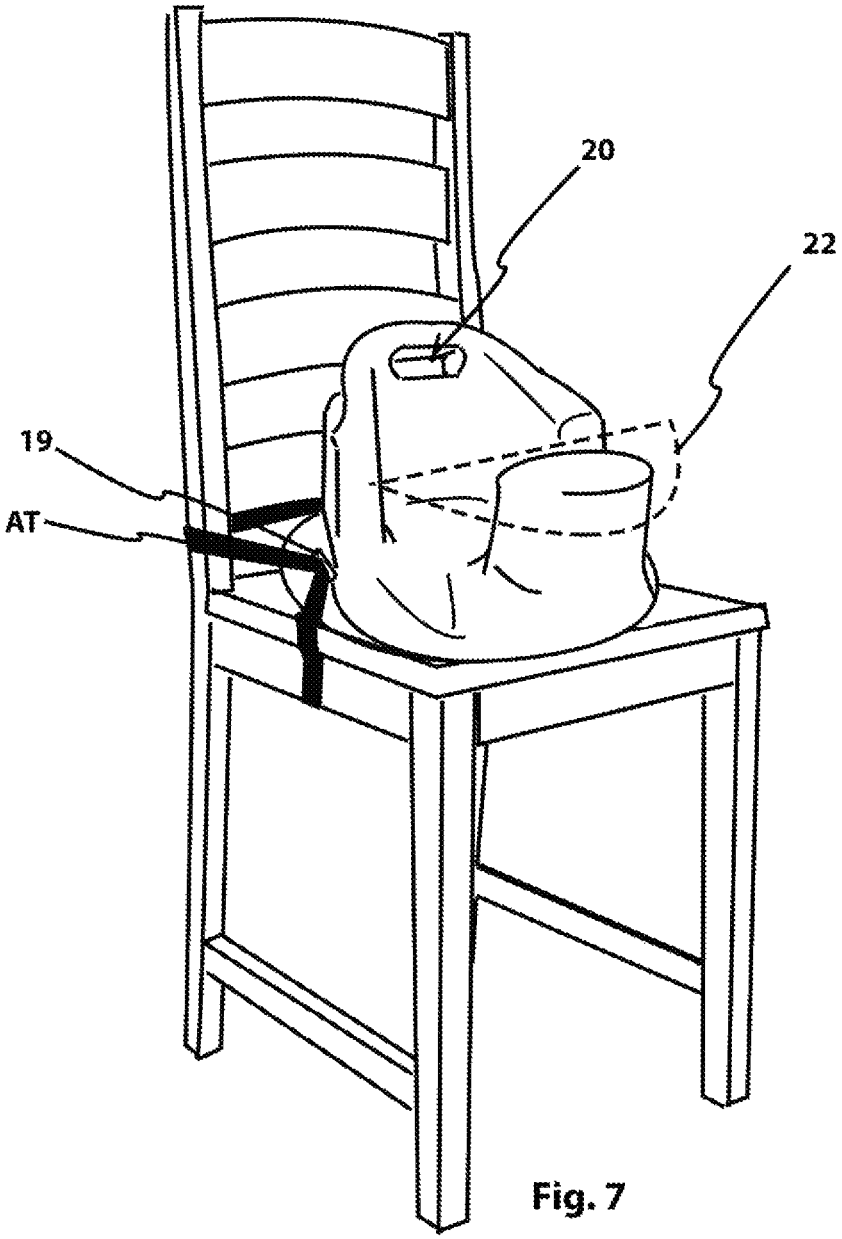
FIG. 7 is a front perspective of an alternative embodiment of the seat structure.

A number of other features may be incorporated in to the seat structure ST as shown in FIGS. 5 to 7. In the embodiment shown in FIG. 5, the seat structure includes fastening mechanism F, in the form of a strap and buckle extending across the seat S which secures the infant in place and/or prevent them from falling out. This is particularly important because the infant will be sitting upright with their core muscles engaged, and with a heightened center of gravity. The strap F passes through sockets 18 in the back B to secure the strap to the seat structure ST.

In the embodiment shown in FIG. 6, the seat structure includes a base 1 that is substantially wider circumferentially than the rest of the seat structure ST. This discourages the seat structure ST from tilting over with the infant. This is particularly important because the infant will be sitting upright with their core muscles engaged, and with a heightened center of gravity.

In the embodiment shown in FIG. 7, the seat structure ST can be secured to the seat of an adult chair using an attachment strap that is secured through openings 19 molded in to the seat structure ST. An aperture 20 is molded in to the back B to facilitate lifting of the seat structure ST. It will also be appreciated that a tray 22, indicated in ghosted outline, can be secured to the side supports and the pommel once the infant is located in the seat structure.

Figure 8:
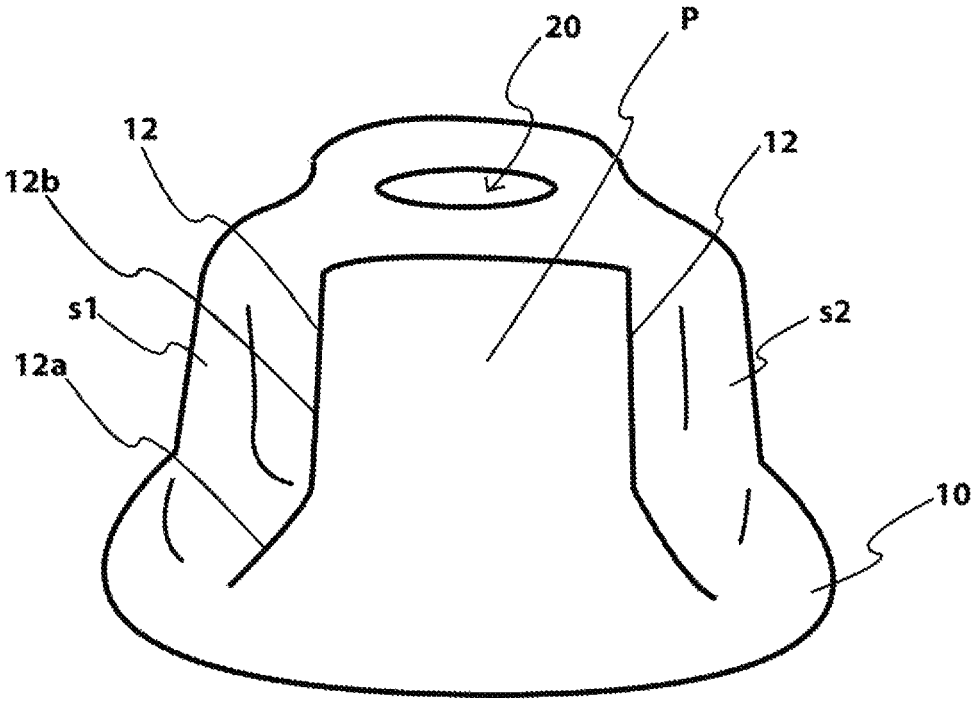
FIG. 8 is a front elevation of a further embodiment of seat structure.
Figure 9:
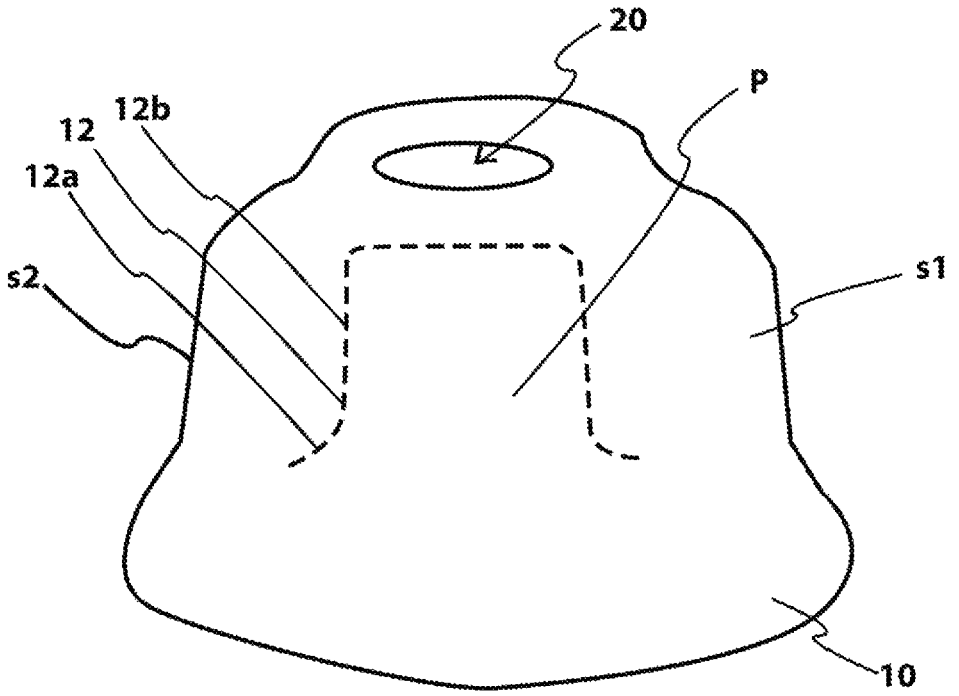
FIG. 9 is a rear elevation of the embodiment of FIG. 8.

In the above embodiment, the pommel has converging oppositely directed flanks. Alternatively, the flanks 12 may extend radially outwardly parallel to each other, and extend upwardly parallel to each other. A particularly beneficial form of pommel P is shown in FIGS. 8 and 9. In this embodiment, the lower portions of the flanks 12 diverge radially outwardly and also converge upwardly, as indicated at 12*a* in FIG. 8. The flanks 12 then smoothly transition to be parallel in the upper portion 12*b* and provide a generally rectangular cross section to the pommel P. This configuration of the pommel P provides a relatively massive base to promote the spreading of the legs and also provides a sturdy upper portion for proper support of the infant, and for a tray.

Although the invention has been described with reference to certain specific embodiments, various modifications thereof will be apparent to those skilled in the art without departing from the spirit and scope of the invention as outlined in the claims appended hereto. The entire disclosures of all references recited above are incorporated herein by reference.

What is claimed is:

1. A seat structure to support an infant in a sitting position, said seat structure comprising a base having a lower support surface and a seat surface oppositely directed to said support surface, a pommel upstanding from the seat surface and located at a forward edge of the seat, a back support extending upwardly from a rear edge of the seat surface, and side supports extending from opposite sides of said back support about a periphery of said seat surface, said back support and side supports co-operating to support an infant in an upright position, said side supports terminating in leading edges that are longitudinally spaced from a rear face of said pommel so as not to extend substantially past the region occupied by the hips of the infant and thereby provide a space to either side of the pommel to permit an infant's legs to project outwardly from the seat structure on either side of the pommel without encumbering splaying of the infant's legs, said seat surface being forwardly inclined to converge toward said support surface in the direction of the forward edge of the seat surface.

2. The seat structure of claim 1 wherein said seat surface is inclined at an angle of between 2 and 20 degrees to said support surface.

3. The seat structure of claim 2 wherein said seat surface is inclined at between 6 and 11 degrees to the support surface.

4. The seat structure of claim 1 wherein said seat surface is substantially planar.

5. The seat structure of claim 1 wherein said pommel has oppositely directed flanks that diverge radially outwardly.

6. The seat structure of claim 2 wherein said outwardly directed flanks converge upwardly.

7. The seat structure of claim 1 wherein radii from the centre of the seat surface to said leading edges of said side supports subtend an angle of between 90 to 200 degrees.

8. The seat structure of claim 7 wherein said radii subtend an angle of between 160 and 190 degrees.

9. The seat structure of claim 1 including a fastening mechanism extending across said seat surface to inhibit egress of an infant.

10. The seat structure of claim 9 wherein said fastening mechanism is a strap secured to said seat structure.

11. The seat structure of claim 1 wherein an attachment strap is provided on said base to secure said base to a support.

12. The seat structure of claim 1 wherein said base is flared outwardly to said support surface to enhance stability of said seat structure.

* * * * *